US008982038B2

(12) United States Patent
Higgins et al.

(10) Patent No.: US 8,982,038 B2
(45) Date of Patent: Mar. 17, 2015

(54) LOCAL DIMMING DISPLAY ARCHITECTURE WHICH ACCOMMODATES IRREGULAR BACKLIGHTS

(75) Inventors: Michael Francis Higgins, Cazadero, CA (US); Sarah Sunyoung Hwang, Sunnyvale, CA (US); Anthony Botzas, San Jose, CA (US)

(73) Assignee: Samsung Display Co., Ltd. (KR)

( * ) Notice: Subject to any disclaimer, the term of this patent is extended or adjusted under 35 U.S.C. 154(b) by 344 days.

(21) Appl. No.: 13/107,657

(22) Filed: May 13, 2011

(65) Prior Publication Data

US 2012/0287167 A1 Nov. 15, 2012

(51) Int. Cl.
*G09G 3/36* (2006.01)
*G09G 3/34* (2006.01)

(52) U.S. Cl.
CPC ..... *G09G 3/3413* (2013.01); *G09G 3/342* (2013.01); *G09G 2320/0646* (2013.01); *G09G 2320/0673* (2013.01); *G09G 2360/145* (2013.01)
USPC ..... 345/102

(58) Field of Classification Search
USPC ..... 345/102
See application file for complete search history.

(56) References Cited

U.S. PATENT DOCUMENTS

2007/0279372 A1* 12/2007 Brown Elliott et al. ..... 345/102
2008/0278432 A1* 11/2008 Ohshima ..... 345/102
2009/0015543 A1* 1/2009 Wei et al. ..... 345/102
2010/0002026 A1* 1/2010 Seetzen et al. ..... 345/690
2012/0120096 A1* 5/2012 Johnson et al. ..... 345/596

FOREIGN PATENT DOCUMENTS

WO WO2010045039 * 4/2010 ..... 5/40
WO WO 2010045039 A1 * 4/2010 ..... G06T 5/40

* cited by examiner

*Primary Examiner* — Quan-Zhen Wang
*Assistant Examiner* — Chad Dicke
(74) *Attorney, Agent, or Firm* — Innovation Counsel LLP

(57) ABSTRACT

A display system and method for displaying an image on the display system are provided. The display system includes a display panel and a backlight for illuminating the display panel, the backlight including one or more light emitting zones that each emit light in response to a backlight drive value. The display system further includes a backlight selection module for selecting the backlight drive value for each light emitting zone from image data, an effective backlight module that generates effective backlight signals using light spread information for the backlight and the backlight drive values, and a module for modulating the image data according to the effective backlight signal and providing the modulated image data to the display panel. The light spread information includes information representing the contribution of light from each light emitting zone over the display panel.

19 Claims, 5 Drawing Sheets

LOCAL DIMMING DISPLAY ARCHITECTURE WHICH ACCOMMODATES IRREGULAR BACKLIGHTS

BACKGROUND

A backlight is often used as a light source for display devices, such as Liquid Crystal Display ("LCD") devices, in which a display panel is illuminated to display an image. Many new display devices utilize some form of Dynamic Backlight Control ("DBLC"), in which the illumination level of the backlight is adjusted in accordance with the light requirements of the image to be displayed on the display panel. In Dynamic Backlight Control, the illumination level of the backlight is modified based on the image data for a frame. In generalized terms, for dark images, the illumination level of the backlight is lower, and for bright images, the backlight illumination level is higher. Then, the inverse of the backlight illumination level is applied to the display panel light filter control (e.g., the LCD shutter), to compensate for the varying level of illumination from the backlight. The resulting image is the same as the original, i.e., the image with the backlight fully illuminated. Dynamic Backlight Control allows the power consumption of the backlight to be reduced while maintaining the visual brightness and quality of the display.

Dynamic Backlight Control systems typically utilize global dimming, and as a result the illumination level of the entire backlight must satisfy the light requirement of all of the pixels that make up the image. This means that some regions of the display that only require low backlight illumination levels have an unnecessarily high illumination level. Recently, methods for local dimming of independent light elements within a backlight have been developed. In local dimming methods, the backlight has a number of independently controllable light elements used to illuminate the display. The illumination level of each light element can be individually adjusted in correspondence with dark and bright areas of the image to be displayed on the display panel. Thus, requirements for a high level of illumination in one area of an image do not require the entire backlight to have a high level of illumination, and power is conserved.

On the other hand, uniformity of backlight illumination across the entire display panel is considered a desirable quality for displays as it improves the quality of the image, and backlights strive to illuminate the display panel evenly. Thus, backlights are carefully designed to result in a uniform spread of light across the display panel. For instance, when light emitting diodes ("LEDs") are used to make the backlight, they are often carefully chosen and arranged to prevent dark or bright spots, and special diffuser sheets are also used to further spread the light that passes through them.

An architecture for a display system that can locally dim the backlight and also provide a high quality image is required.

SUMMARY

A display system is provided that includes a display panel for displaying image data, a backlight for illuminating the display panel, the backlight including one or more light emitting zones, each light emitting zone emitting light in response to a backlight drive value controlling an amount of light emitted from that light emitting zone; a backlight selection module for selecting the backlight drive value for each light emitting zone from the image data, an effective backlight module that generates effective backlight signals using light spread information for the backlight and the backlight drive values, wherein the light spread information includes information representing the contribution of light from each light emitting zone over the display panel, and a module for modulating the image data according to the effective backlight signal and providing the modulated image data to the display panel.

The light spread information may be point spread function data measured for each light emitting zone and contained in a PSF table.

The effective backlight module may use the PSF table to generate a table of effective backlight signals, the table of effective backlight signals having lower resolution than the image data. The effective backlight module may also include an interpolation block that interpolates the low resolution table of effective backlight signals to produce an effective backlight signal for each pixel of image data. The effective backlight module may include a look up table including the light spread information, a block for generating a table of effective backlight signals using the look up table, the table of effective backlight signals having a lower resolution than the image data, and a block for interpolating the low resolution table of effective backlight signals up to a pixel resolution of the image data.

The image data may include a plurality of pixel data, and each pixel data is divided by an effective backlight signal corresponding to that pixel to generate the modified image data for each pixel.

Each light emitting zone may include one or more light emitting diodes. Each light emitting zone may include colored light emitters.

The light spread information may include data modeled on each light emitting zone of the backlight.

The backlight selection module may include a survey block for surveying the image data in a survey area of each light emitting zone and determining an initial backlight drive value for each light emitting zone, wherein the survey area of each light emitting zone includes a set of pixel data to be displayed on an area of the display panel, and a decay block using a smoothing function to modify the initial backlight drive value to generate the backlight drive value. The decay block may include backlight drive values from a previous frame to modify the initial backlight drive values.

The display system may further include a gamma mapping module for converting the modulated image data from a three-color value data to a multi-primary color value data.

The survey block may receive the multi-primary color value data and surveys the multi-primary color value data in each survey area to determine a GMA value, and wherein the decay block uses the GMA values and backlight drive values from a previous frame to generate the backlight drive value from the initial backlight drive values.

In another aspect, a method for displaying an image is provided. The method may be implemented in a display system having a backlight that illuminates a display panel, the backlight including one or more light emitting zones, each light emitting zone emitting light in response to a backlight drive value. The method may include receiving image data into the display system, determining a backlight drive value for each light emitting zone from the image data, loading a light spread information table into the display system, the light spread information table including point spread function information for each light emitting zone, generating effective backlight signals from the backlight drive values and the light spread information table, modifying the image data received into the display system by the effective backlight signal to generate a modified image signal, and providing a modified image signal to the display panel.

Generating the modified backlight signals may include generating a table of initial effective backlight signals having a lower resolution than the image data, and interpolating the table of initial effective backlight signals to a resolution of the image data before generating the modified image signal.

The light spread information table may be a table of measured point spread information for each light emitting zone.

The image data may include a plurality of pixel data, and each pixel data is divided by an effective backlight signal corresponding to that pixel to generate the modified image signal.

Determining a backlight drive value for each light emitting zone from the image data may include surveying the image data in a survey area of each light emitting zone to determine an initial backlight drive value for each light emitting zone, wherein the survey area of each light emitting zone includes a set of pixel data to be displayed on an area of the display panel, and decaying the initial backlight drive values with a smoothing function to generate the backlight drive values. Decaying the initial backlight drive values may include decaying the initial backlight drive values with backlight drive values from a previous frame to modify the initial backlight drive values.

The method for displaying an image may further include converting the image data from a three-color value data to a multi-primary color value data. The method may further include surveying the multi-primary color value data in each survey area to determine a GMA value, and decaying the initial backlight drive values with the GMA values and backlight drive values from a previous frame to generate the backlight drive values.

In another aspect, a method of manufacturing a display device is provided. The method may include forming a transmissive display panel capable of displaying an image, forming a backlight to illuminates the transmissive display panel, the backlight including one or more individually addressable light emitting elements, measuring point spread function data on the transmissive display panel for each light emitting element, loading the point spread function data into a control system used to display image data on the transmissive display panel.

DETAILED DESCRIPTION

Figure 1A:
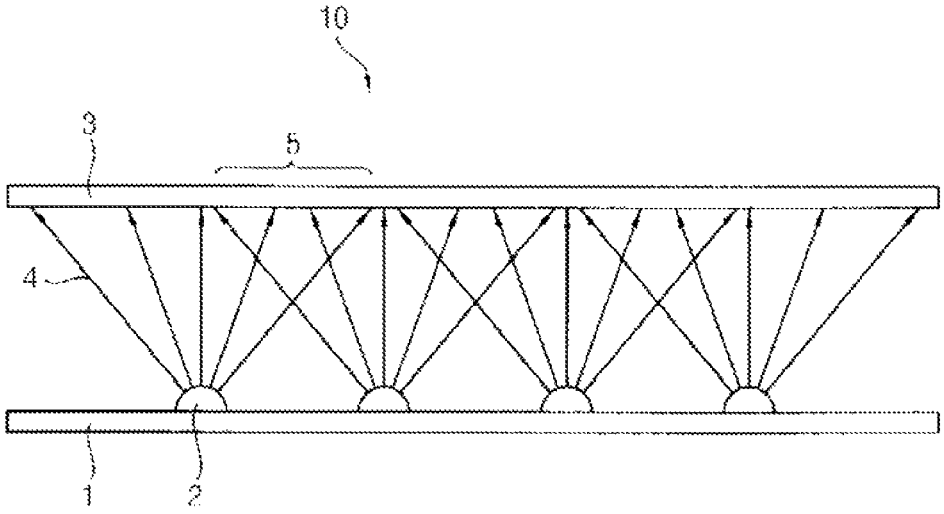
FIGS. 1A and 1B show a diagram of a display system with light emitting elements.

FIG. 1A shows a diagram of a display system 10 having a backlight 1 that includes a number of light emitting elements 2 that illuminate a display panel 3. The light emitting elements 2 each provide light, indicated by rays 4, to the display panel 3. Each of the light emitting elements 2 may be individually controlled, such that the level of illumination provided by each light emitter can be modulated, and local dimming achieved. FIG. 1A also illustrates how portions of the display, e.g. portion 5, may be illuminated by light from more than one of the light emitting elements 2. That is, each light emitting element provides, or spreads, light over the display panel, and the light provided by each light emitting element may overlap.

Figure 1B:
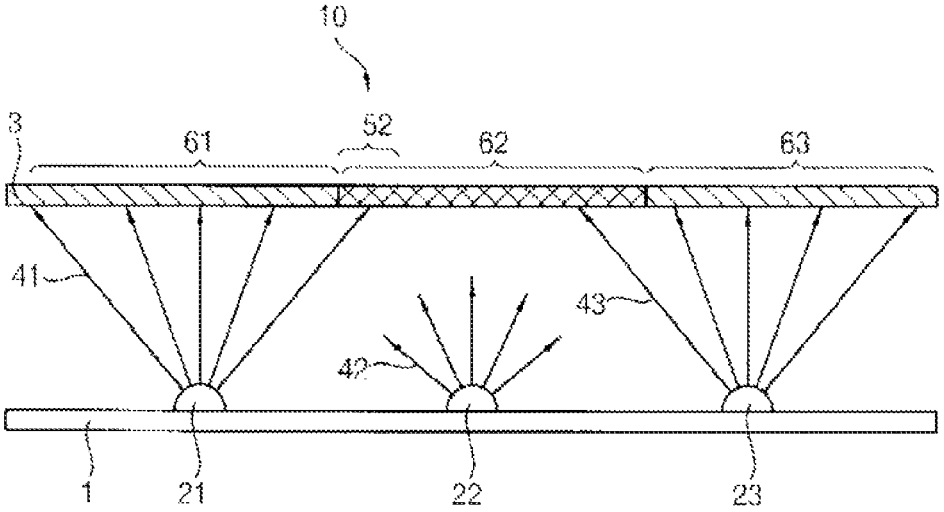

FIG. 1B illustrates, in a simplified diagram, the difficulty that the light spread may cause when determining the illumination level required by each light in local dimming. In FIG. 1B, the display panel 3 displays an image that has two relatively bright sections 61 and 63, that are primarily illuminated by light emitting elements 21 and 23. The display panel also has one relatively dark section 62 that is primarily illuminated by light emitting element 22. Thus, the illumination levels for light emitters 21 and 23 are determined to be high so that sections 61 and 63 are brightly illuminated, and the illumination level from light emitter 22 is determined to be relatively low, so that section 62 is dark. However, some regions of section 62, for instance region 52, receive light from light emitters 21 and 23, and thus receive more light than is required. In other words, in the local dimming system, the light from the backlight is varied spatially, across the display panel.

A method for accounting for this spatial variance in illumination levels is to modify the amount of light allowed to pass through the display panel in accordance with the amount of light the display panel actually receives from the combination of all of the light emitting elements. For example, in the simplified diagram of FIG. 1B, where light from light emitting element 21 enters display panel section 62 in region 52, the amount of light that that is allowed to pass through the display panel in region 52 is lowered. In an LCD display, for instance, pixels in region would be set to a darker value.

In the diagram of FIG. 1B, each of the light emitting elements 21, 22 and 23 are shown as individually controllable. However, some backlights may employ groups of light emitting elements that are controllable as a group. Each such group of light emitting elements is referred to herein as a light emitting zone. Each light emitting zone contains one or more light emitting elements that are controlled together in the light emitting zone, but independent of other light emitting zones in the backlight. Thus, local dimming of the backlight occurs light emitting zone by light emitting zone.

To implement the method for accounting for the spatial variance in illumination levels, display systems of the embodiments include information on the amount of light provided by each light emitting zone over the area of the display panel. This information may be in the form of the point spread function ("PSF") for each light emitting zone in the backlight. The point spread function information may be modeled or it may be measured. Modeling the point spread function information may be accomplished by methods known to those of skill in the art. In one example, the point spread function information can be modeled by starting with the PSF of a light emitting zone, duplicating the PSF for each light emitting zone on the backlight, and then summing the model PSF for each light emitting zone at each position on the display panel.

A difficulty with modeling the PSF data is that the area and amount of light spread across the display panel from one light emitting zone may be different from the next light emitting zone. For example, light emitters that are near an edge may reflect light back into the display screen in a way the light emitters in the middle of a display do not. Also, light emitters do not necessarily illuminate identically, and may not emit the same amount of light for a given drive signal. Additionally, the light emitting zones may have irregular arrangements, or use different colors of light emitters.

Using actual measurements of the PSF can overcome these difficulties. In general, measurement can provide a more accurate point spread function by taking account of various irregularities that are difficult to model. Edge effects, for example, may be more accurately accounted for by measurement of the point spread function. Additionally, any kind of non-uniformity between the backlight emitting zones or irregular arrangements of the light emitting zones can be accounted for. Additionally, odd point spread functions, for instance cones, can be accommodated. Thus, a display system that utilizes measured light spread information can accommodate any irregularity of point spread function shape or any irregularity of arrangement of LED elements. Even edge-lit backlights may be used.

To measure the PSF for a backlight having light emitting zones, the point spread function of each light emitting zone is individually measured. That is, all of the light emitting zones except one are in the off state, and the PSF of the one light emitting zone that is on is measured. This is performed for each of the individual light emitting zones of the backlight.

The modeled or measured light spread information for the backlight may be formatted into a table. For instance, a point spread function look up table ("LUT") may be used. The PSF LUT may be used in a display system as described with reference to FIG. 2.

Figure 2:
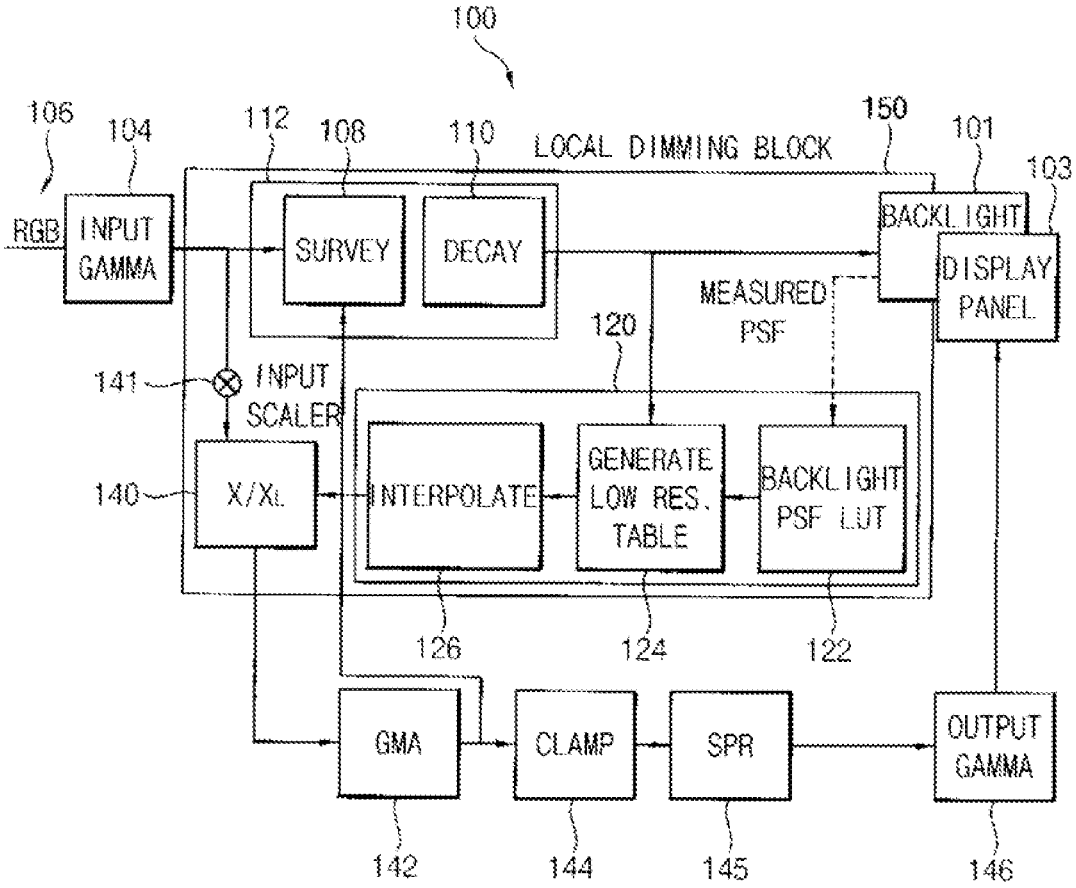
FIG. 2 is a block diagram representing the architecture for a local dimming display system.

FIG. 2 is a block diagram representing the architecture for a local dimming display system 100 that includes the light spreading information for the backlight. The display system of FIG. 2 includes a backlight module 101 and a display panel 103. As used herein, a "module" or "block" refers to software, firmware, or a computer-readable hardware device programmed with instructions.

Backlight Module

Backlight module 101 includes one or more light emitting zones that can be individually controlled in response to a backlight drive value. A backlight drive value is applied to each light emitting zone and determines the amount of light, or illumination level, that that the light emitting zone will emit. The backlight drive values are thus used to modulate the light provided by the light emitting zones. The light emitting zone may include one or more light emitters from any emissive light source, including, for example, CCFL or white LEDs. The light emitting elements may also include colored light sources, for example, red, green and blue LEDs. Other types of backlights may be used such as Field Emission Display panels, perhaps with Carbon Nano Tube electron emitters, Organic Light Emitting Diode panels, or Plasma Display Panels. In fact, any addressable, multi-emission-zone light source may be used.

Display Panel

The display panel is a transmissive display, such as an LCD, in which color images are formed by combining the individual color disposed on a color filter substrate in an arrangement, or layout, referred to as a subpixel repeating group. Any transmissive flat panel display technology that provides an array of light valves may be used. One such light valve technology is a sliding shutter Micro Electro-Mechanical System (MEMS) display. Another transmissive display panel that may be used in the current invention is Electro-Wetting Display, in which instead of Liquid Crystal materials effecting a light valve, colored oils displaced or moved by water in response to voltage levels is used. The list may also include electro-chromic displays.

Although in this disclosure, the invention is explicated using a locally dimmable backlight and transmissive panel, it should be understood that the relationship of the light generating and light modulating devices may be reversed and the current invention's methods applied. Any number of reflective display technologies may be combined with a "frontlight," illuminated from the top by a transparent light emitting device. For example, a reflective LCD may be illuminated from the front (or "top") using a lightguide, such as a wedge of clear plastic and provided with independently controllable LEDs which may selectively illuminated different regions of the reflective display. Other reflective displays may be used such as Electro-Phoretic or interference etalon MEMS.

Input Gamma Block

Image data is input into the system at 106 and may be processed by (optional) input gamma block 104. Input gamma block 104 processes the input image data to linearize it, often with an input gamma LUT. Input gamma block 104 is used to adjust for gamma if the display is of the type that needs gamma adjustment (e.g., LCD), and may be omitted depending on the type of display. Input gamma block 104 may also introduce some dithering on the input side of the data pathway. Display systems may introduce quantization error when processing/performing calculations on the data flowing through the data pathways. Introducing some dithering may decrease quantization error, and in a system with sub-pixel rendering ("SPR"), patterned input dithering may be substantially filtered out, resulting in decreased quantization noise with no side effects.

As shown in FIG. 2, input image data may take two paths—a backlight path for control of the backlight 101, which includes the local dimming blocks 150, and a data path for control of the display panel 103.

Backlight Path—Backlight Selection Module

In the backlight path, the survey block 108 and backlight decision and decay block 110 collectively form a backlight selection module 112. Backlight selection module 112 determines, for a frame of image data, the backlight drive values to be applied to each of the light emitting zones in the backlight module 101. More details of the survey module 108 and the backlight decision and decay module 110, and how backlight drive values are determined for each light emitting zone from the image data, are described below. The backlight drive values are used to drive the light emitters of each light emitting zone of the backlight module 101, and each backlight drive value determines the amount of light the corresponding light emitting zone will emit for that frame of image data.

Backlight Path—Effective Backlight Signal Module

Once backlight drive values are determined they are also used, along with the light spread information for backlight 101, to generate effective backlight signals in the effective backlight signal module 120. The effective backlight signals at each position (e.g., pixel position) in the display area provide an effective image of the backlight that takes into account the spread of light from each of the light emitting zones. The effective backlight signals are used to modify the image data signals provided to the display panel. That is, once the effective backlight signals are generated, they are used as the "$X_L$" values in the $X/X_L$ block 140 of the data path. The $X/X_L$ block 140 will be described in more detail below.

The effective backlight signal module 120 includes the light spread information for the backlight 122, a block 124 for generating a low resolution effective backlight table, and an interpolation block 126 for interpolating the low resolution effective backlight table data up to pixel resolution, to generate the effective backlight signals for use in the $X/X_L$ block 140.

The light spread information 122 is the modeled or measure point spread function information formatted into a table, the PSF LUT, as described above. For memory size reduction and processing simplification, the backlight PSF LUT may be stored at a lower resolution than the measured resolution. Lower-resolution data can be sub-sampled from the full resolution image at defined "sample points" at positions across the full display area. Such lower-resolution data should still, however, contain the measured shape and relative amplitude of each light emitting zone's PSF as it spreads over the display area. Then, for each sample point, the sum of all of the light emitting zones' contribution at that sample point can determine the amount light, that is, the illumination level, behind the position on the display panel at that sample point.

The PSF LUT could be used directly with the backlight drive values to produce the full set of effective backlight signals. However, doing this in real time as the image data for each pixel arrives would be very complex. To decrease the complexity, the effective backlight signals are generated in two stages. First, in block 124 a low resolution effective backlight table is generated from the PSF LUT and the backlight drive values. Then, in real time as the image data for each pixel arrives, the low resolution backlight table is interpolated in interpolation block 126 into a full resolution effective backlight.

The low resolution effective backlight table generated in block 124 is a low-resolution representation of how the full backlight looks after considering the actual backlight drive values and their respective PSF shapes. Generating this table requires multiple memory reads from the PSF LUT. The data from the PSF LUT are then multiplied with the backlight drive values and summed. These memory reads may be performed serially to reduce multiplier logic, but this can result in a longer processing time. A processing timeline is presented below with respect to FIG. 3, but it should be noted that complete generation of the effective backlight table is not required prior to image data arrival for the next frame.

As discussed above, the effective backlight signals are processed with input image data in the $X/X_L$ block 140. That is, the effective backlight signal is "$X_L$" and the input image data is "X." The effective backlight table generated in block 124 is, however, low-resolution, while the input image data is pixel-based. Therefore, a 2-dimensional interpolation is performed in interpolation block 126 to bring the low resolution effective backlight signals up to pixel-resolution. Multiple reads of the low-resolution effective backlight table are required for interpolation. A 2-dimensional interpolation requires 4 values from the table at each step. (Cubic interpolation will require fetching 16 values). The same 4 values (or 16) are used for the many interpolation steps across a scanline, so the next values from the low-resolution effective backlight table can be pre-fetched before they are needed. This result is synchronized with input data.

Thus, for each pixel on the display panel 103, the light contributions from each light emitting zone in backlight 101 is accounted for.

The $X/X_L$ block 140 performs compensation on each subpixel of each pixel and provides modified image data to the display panel through the remaining blocks of the data path. That is, the value of the image data for each subpixel, e.g. X1, X2, X3 . . . is divided by the effective backlight signal $X_L$ for that pixel to produce a modified image signal.

Data Path

Image data input at 106 and optionally processes by input gamma block 104 may next be processed by input scaler 141. The input scaler 141 may, optionally, be used to scale the data, for example to create "indoor" and "daylight" modes. After scaling, the image data is processed by the $X/X_L$ block 140 as described. The modified image data from the $X/X_L$ block 140 may then be used to display an image on the display panel 103, although additional processing of the modified image data may be required or desirable depending upon the type of display panel that is used.

The modified image data may be input into gamut mapping ("GMA") function block 142. The GMA function transforms the modified image data specified as an RGB primary color set to a multi-primary set of colors. GMA is used for displays that use four or more non-coincident color primaries in the display panel, for instance RGBY, RGBC, RGBW RGBCW, etc. Techniques of GMA are well known. GMA function block 142 may utilize any of the gamut mapping algorithms disclosed, for instance, in U.S. Pat. Nos. 7,893,944 "Gamut Mapping and Subpixel Rendering Systems and Methods," 7,728,846 "Method and Apparatus for Converting from Source Color Space to RGBW Target Color Space," and 7,619,637 "Systems and Methods for Improved Gamut Mapping from One Image Data Set to Another" or otherwise known in the art. For example, in the case of a display system that produces images on a display panel having an RGBW subpixel repeating group, GMA function block 142 utilizes an RGB to RGBW algorithm. In this case, the output of the GMA block 142 is modified image data values in RGBW color space.

The set of gamut-mapped modified image data values produced by GMA function block 142 may then be input into clamping block 144. The RGBW modified image data may contain out of gamut colors whose red, green, or blue value may exceed the maximum allowable value. "Clamping" refers to a technique of forcing a value that is out of gamut back into an acceptable range. If, after gamma mapping in GMA block 142, a value is out of gamut, then clamping block 144 clips the value to ensure that all final values are within gamut. Clamping is done carefully to cause minimum change to the hue, and the techniques for claiming are described, for instance, in U.S. Pat. No. 7,893,944 "Gamut Mapping and Subpixel Rendering Systems and Methods"

After clamping, processing may optionally proceed with sub-pixel rendering ("SPR") in SPR block 145. If the display panel comprises any one of a novel subpixel repeating groups, as is described, for instance, in U.S. Pat. Nos. 7,876,341 "Subpixel Layouts for High Brightness Displays and Systems," 7,701,476 "Four Color Arrangements of Emitters for Subpixel Rendering," and 7,583,279 "Subpixel Layouts and Arrangements for High Brightness Displays," then subpixel rendering is applied to the modified image data to subpixel render the modified image data onto the display. Finally, modified image data may be processed in an optional output gamma block 146 before the modified image data signals are sent to the display 103—e.g., to drive individual subpixels upon display 103.

Although the embodiment for the data path described herein is described principally as it applies to RGBW display systems, it will be appreciated that the systems and techniques of the present invention apply as well to other multiprimary systems (e.g. RGBY, RGBC, RGBCW, etc.) with suitable adjustments. It will also be appreciated that the architecture described herein does not rely on the use of GMA or SPR processing necessarily, but would also work with conventional RGB stripe display systems that do not have GMA or SPR. It will be understood, however, that the architecture described herein may work well with such advanced multiprimary systems and may offer benefit over and above what may be possible with such legacy RGB stripe display.

Backlight Selection Module—Survey Module and Backlight Decision and Decay Module As described above, the backlight path uses backlight selection module 112 to determine backlight drive values for each light emitting zone. Determining the backlight drive values for each light emitting zone is an iterative process that may utilize the input image data, the results of the GMA processing of the modified image data from module 142, and the backlight drive values from the previous frame. The backlight selection module 112 may include a survey module 108 and backlight decision and decay module 110.

Survey module 108 performs the survey of the input image data, and, optionally, the results of the GMA processing of the modified image data from module 142.

For performing the survey, each light emitting zone on the backlight has a corresponding survey area on the display panel. The survey area generally includes the pixels on the display panel that are in an area that is substantially illuminated by the light emitting zone. Another way to look at it is the survey area for a light emitting zone is the set of pixels that the light emitting zone affects. The survey area for a light emitting zone may be any set of pixels, but setting the survey area to the area of point spread function for the light emitting zone, or larger, ensures that the effect of each light emitting zone is taken into account for a pixel. An individual pixel may be, and, in fact, is likely to be, in more than one survey area.

Considering first the input image data, for each light emitting zone, statistics are kept on the image data for pixels in that light emitting zone's survey area. The term "statistics" as used here refers to, in a survey area of one frame of image data, statistics for a value that may vary pixel to pixel that relate to the optimal backlight requirement for each pixel. For example, a peak value method may be used. The peak-value method checks all of the pixels in a survey area of a frame to determine which pixel requires the highest backlight level for proper image display, and sets the backlight level for the survey area for the frame at the level that is required by that pixel.

In other words, the peak value method selects a backlight level that is equal to what is theoretically required for a given survey area. Other method may also be used, for instance, a histogram-based method, such as is described in U.S. Patent Publication Number 2009/0284456 or a hybrid peak value/histogram-based method, such as is described in U.S. Patent Publication Number 2011/0025592.

As each pixel of image data arrives in survey module 108, it is first determined if it is within the survey area of the light emitting zone, then it is surveyed and statistics are kept for the survey area. The pixel of image data is surveyed in each survey area in which the pixel is located.

The results of the survey of the image data may, at this point, be used directly for the backlight drive values used to drive the backlight. However, a more energy efficient algorithm would also consider the survey results of the neighboring zones. Such algorithms typically "bump-up" or increase the drive value of a certain zone if any of its neighboring zones has reached 100% drive value but has yet to reach its target demanded by its own survey, which can save energy. Additionally, it is often useful to perform some additional processing to make a better determination (i.e., temporally smoother and less prone to erratic oscillations) of the backlight drive value for each light emitting zone: This step is performed in the decay module 110, and may use the survey results for the GMA modified image data from module 142 as well as the backlight drive values for the previous frame.

The results for the GMA modified image data from module 142, if used in the additional processing in decay module 110, are first surveyed in survey module 108. The survey on the GMA modified image data is performed in the same manner as the input image data and a GMA value is determined for each survey area. The peak GMA value rises as the input color becomes more saturated, requiring more backlight energy in that color to maintain the brightness of that color. In this case, arrival of the input image data values into survey module 108 may be delayed so that they are available at the same time as the results of the GMA. Coordination of both input sources could accommodate a single survey, which would avoid duplication of survey logic.

First the survey results on the GMA modified image data ("GMA values") are used to predict better backlight drive values. If the largest GMA value for a particular LED zone is out of gamut, this means the LED zone could be turned up so as to prevent this. If, on the other hand, the GMA value is in gamut, then the LED zone could be turned down to save power. To use the GMA values, the backlight drive values from the previous frame are multiplied by the GMA values. To use the GMA value, the backlight drive values of the previous frame are multiplied by the GMA value for each survey area.

Sudden changes in the image and noise in the image could cause the backlight to rapidly change between different values. To prevent this, the new backlight drive values determined from the input image data may be decayed, temporally filtered, with the previous backlight drive values (that may have been multiplied by the GMA values), so the backlight is required to change slowly over time. Any number of dampening or smoothing techniques is possible, as described, for example, in U.S. Pat. No. 7,592,996 "Multiprimary Color Display with Dynamic Gamut Mapping."

Block-Level Processing Timeline

Figure 3:
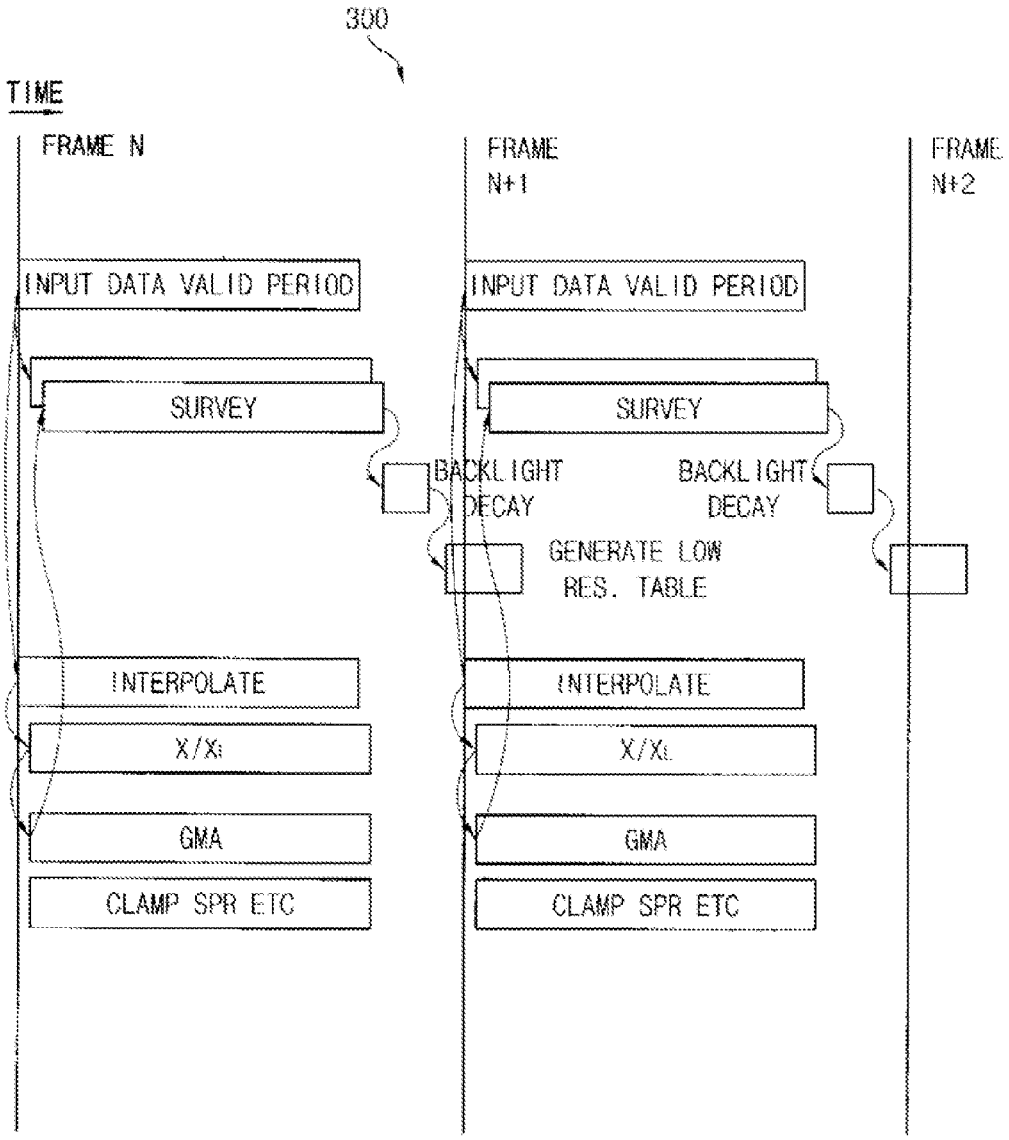
FIG. 3 is a block-level processing timeline for the architecture shown in FIG. 2.

FIG. 3 is a diagram that shows a processing timeline 300 of the local dimming blocks for the embodiment illustrated in FIG. 2. Some processing occurs while input image data is passing through the display system, while other processing occurs during the blanking period. Note, however, the generation of the low-resolution backlight table is not complete prior to the arrival of image data for the next frame. Thus, there is an overlap between the generation of the effective backlight table and input data processing. Alternatively, generation of the effective backlight table may be completed within the blanking period, which may pose somewhat less risk to smooth functioning of the display system, as generation of the effective backlight table only actually needs to be completed as needed for pixels as they arrive. This timing method allows for more sequential calculation, which reduces logic resources. The time required to generate the effective backlight table may also be shortened by changing the memory structure of the PSF LUT, and adding more parallel calculations.

Example Implementation in Display System with a Backlight Having Colored Leds

As discussed above, the local dimming architecture of the embodiments can accommodate backlights having irregular light emission across the display panel. In one embodiment, the backlight may include independently controllable colored LEDs as light emitting zones. An example implementation of the local dimming architecture with a backlight having independently controllable colored LEDs will now be described. A local-dimming system that included a PenTile RGBW subpixel LCD display and an LED Backlight module with a 2-dimensional, direct-lit arrangement of RGB LEDs was implemented and tested based on simulation of the algorithms.

Hardware used in the example implementation was provided by Samsung Electronics Co., Ltd., including an LCD display panel, a backlight module and associated PCB boards, FPGA and TCON hardware.

The backlight module 101 in this example implementation was constructed to have 48 light emitting zones (the "LED zones"), 8 across and 6 down. Each LED zone contains independently controllable colors of Red, Green and Blue LEDs. However, different and/or additional colors of LEDs, for instance, emerald green, as well as other arrangements of the LED zones may be used in the backlight module 101.

Data Path for Display System with Colored LED Backlight

The details of the data path for the example implementation with a colored backlight will be described first. Following FIG. 2, in an input gamma module 104 8 bit image data input values were assumed and an sRGB-like gamma table, as is known in the art, was used to produce 12-bit linear values. The linear values were scaled in input scaler 141 to create "indoor" and "daylight" modes. Scaling by ½ at this point will make white pixels have a 50% brightness, but will allow bright saturated colors to display at 100% brightness without going out of gamut.

Such scaling could be accomplished in several places, for instance during $X/X_L$ processing and during the survey in survey module 108. Performing scaling at the beginning of the processing, as in this implementation, is simpler, but distributing the scaling through the data processing pipeline will result in less quantization error.

Figure 4:
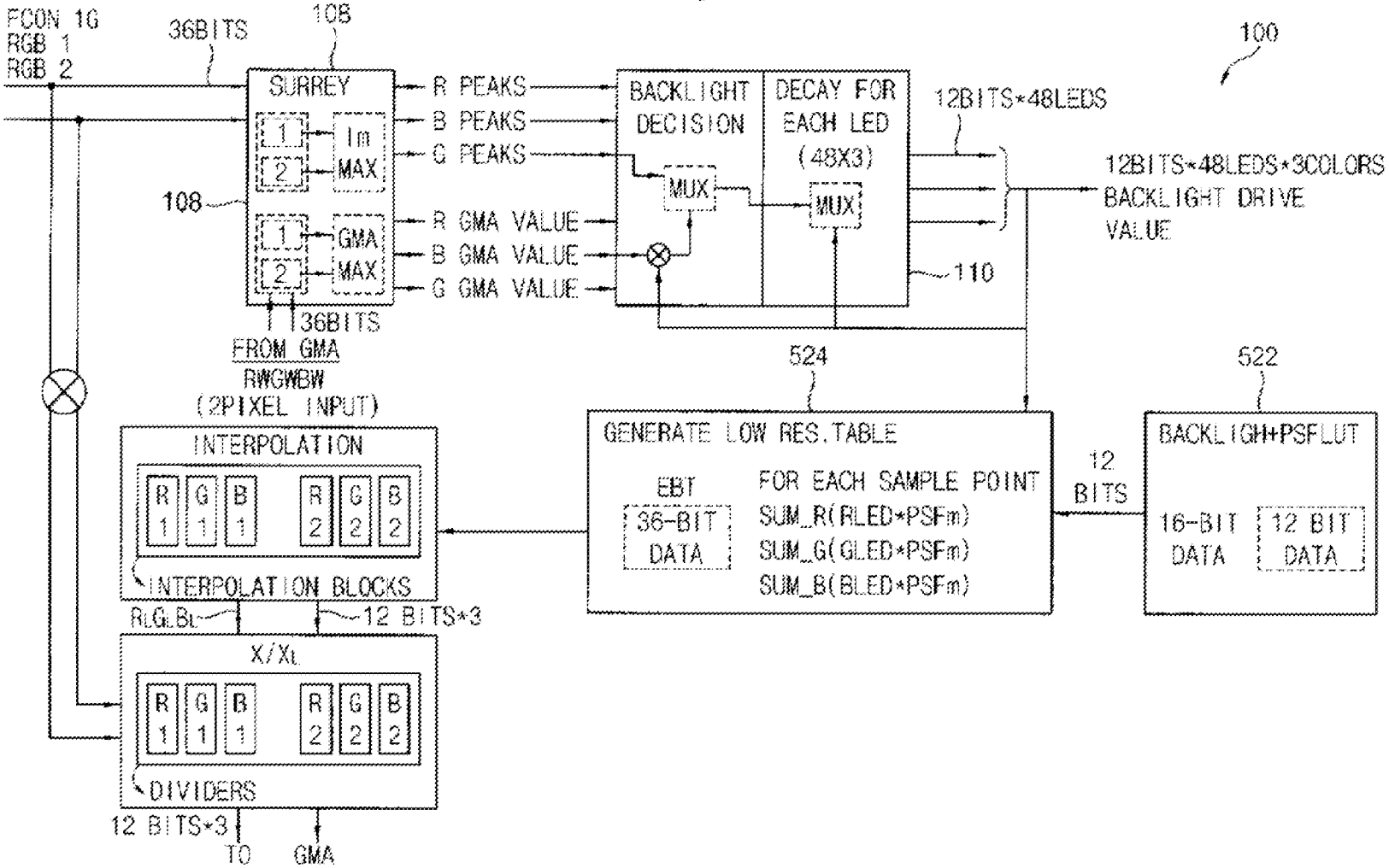
FIG. 4 is a more detailed diagram of a local dimming block from the architecture of FIG. 2.

$X/X_L$ processing of the image data occurs in the $X/X_L$ block, which is shown in the diagram, FIG. 4, of the local dimming block 500 used in this implementation. In the $X/X_L$ block 540, the "over $X_L$" values are calculated once for every pixel. Also, there are three "over $X_L$" values instead of one (that is, one each for Red, Green and Blue). With a color backlight, some of the primary colors must be allowed to go to low illumination levels, even to zero. The descriptor for $X/X_L$ has some logic that can detect zero values and return reasonable modified image data values in all cases. There is also a special case for zero/zero that makes the RGBW GMA work in this environment with no changes from a white backlight. (See the calcxxl function in the descriptor in Table 1, below).

The modified image data goes to the RGBW GMA block 142, as is known the art. The GMA does not need to know that the W values it is outputting are not necessarily white any more. It reads in RGB values and outputs RGBW values. The R and G and B values are allowed to go 2 times out of gamut on output. The W values are always in range. In this RGBW GMA block 142, the modified image data values input have the ability to be out of gamut. Thus, the multipliers in the GMA will have to accept values that have an extra bit of precision. Also, the results of the GMA processing may be allowed to go two bits out of gamut, and the clamping block 144 brings them back into range.

At clamping module 144, various clamping methods, such as clamp to black, clamp to luma and clamp diagonal, as well as more recently developed clamping techniques such as non-linear scaling, may be used to clamp the data. A "clamp diagonal" algorithm, however, assumes the W sub-pixel decreases saturation of any output color, and this is not true with a color backlight when the W sub-pixel can be displaying any color. A clamp to black algorithm is used to clamp modified image data.

The SPR module 145 used meta-luma sharpening, as explained in U.S. Pat. No. 7,787,702 "Multiprimary Color Subpixel Rendering with Metameric Filtering." The SPR module is a filtering operation. The descriptor uses random-access reads of an intermediate frame buffer to collect all of the values needed for the filter. The hardware must have a line buffer and timing delays to store the last few lines and present the correct values to the filters. Also, while in this implementation the modified image data values are clamped before SPR, in other embodiments out of gamma values may be allowed to go through the SPR module before claiming.

The descriptor used for output gamma module 146 uses floating point arithmetic to quantize the linear values from 12-bit directly into 8-bit non-linear values. A gamma of 0.45 is used. Other output gamma modules that, for example, quantize the 12-bit value down to 10-bits non-linear values based on an inverse of the measure LCD gammas may be used. A spatial-temporal dither to reduce the 10-bit values to 8-bit values may then be used.

Backlight Path for Display System with Colored LED Backlight

The details of the backlight path for the example implementation with a colored backlight will now be described. FIG. 4 shows the local dimming block 500 used in this implementation. The local dimming block 500 is similar to the local dimming block 150 illustrated in FIG. 3 with each of the blocks and modules in FIG. 4 performing essentially the same function as in FIG. 2. However, more detail for use of the local dimming block 500 with a colored backlight is included in FIG. 4.

In the backlight path, the backlight drive values calculated from the previous frame are turned into the effective backlight table using measured PSF data (loaded into block 522). Calculating the effective backlight table can start during the vertical retrace time, and continue during the display time, as long as the first several lines are available at the start of the frame. When the hardware is turned on, the modified image data values for use in this step can be initialized to half values (2048). From this initialized value, they will decay to the correct value after only 11 frames or less.

To measure the PSF of each LED color of each light emitting zone (the "LED zone"), a Radiant Imaging Colorimeter was used to take images of the full display area for each. It was not assumed that each zone's PSF was the same and then replicated over the full display, because of variations in light emitting zones as described above. Instead, the contribution of each LED zone was measured. Because each color is measured separately, and each has a difference luminance perception to the human vision system, the light distribution is measured in radiance energy instead.

Ideally, a measured PSF table would hold data for each and every pixel on the panel for each LED zone. Then for each pixel, the sum of all LED-zone contributions would determine the light behind it. However, that amount of data was not practical. Instead, a low-resolution "picture" of the measured PSF data, the PSF LUT was used. The picture is at 4 times the resolution of the LED zone, plus an extra sample at the edge. With the current backlight unit containing 8×6 addressable LED zones, the PSF LUT contains (8*4+1)×(6*4+1) or 33×25 sample points for the whole screen of the display panel for each LED block. There are one each of these tables for each of the 48 LED zones, but to make addressing easier for the hardware, space is reserved for 64 LED zones. This makes the size of the PSF LUT around 52,800 12 bit numbers. The addressing scheme for the PSF LUT is a 16 bit address with the sample point address in the upper 10 bits and the LED zone number in the lower 6 bits. Once a sample location is chosen in the upper 10 bits, the lower 6 bits can be incremented from 0 to 48 to fetch the PSF values at that location for all of the backlight LED zones.

Each value in the PSF LUT is a normalized 12-bit brightness value. A value of $2^{(12-1)}$ (MAXCOL or 4095) is the brightest possible value that any LED zone can produce. These normalized values were produced, for example, in a Mathcad sheet that reads measured data and generated the whole PSF LUT in the right order. These were monochrome values that are used for R and G and B backlight drive values. At a given sample point, the backlight drive values times the PSF value right shifted 12 times is the brightness of the LED zone at that point.

The descriptor for the effective backlight module 524 loads the PSF LUT. The low-resolution effective backlight table (524) was built at the resolution of the PSF LUT, 33×25 sample points. For each sample point in this table, the effect of all 48 PSF values, times the backlight drive value for the LED zone, is summed. This sum is potentially 18 bits wide. It is divided by a fixed value, the maximum brightness that can be produced by the backlight, to bring it back down to a 12 bit number. The maximum brightness divisor is a fixed value that can be calculated from the PSF LUT. For a given PSF LUT, it is a constant and does not have to be re-calculated. The divisor is converted to a 12 bit fixed point multiplier to make generating the effective backlight table easier.

As shown in FIG. 3, it may take longer to generate the effective backlight table than the duration of the vertical retrace time. However, only the first two or three lines of this table are necessary to start processing the first line. Thus, the generation of the effective backlight table can be allowed to continue in parallel with the processing of the next frame of image data. This required a dual-ported memory for the effective backlight table, or some other sort of access arbitration to allow writing and reading at the same time.

Table 1 shows an example implementation, in pseudo-code Lua, of generation of the low resolution effective backlight table.

As described above with respect to FIG. 2, at the $X/X_L$ module 540, the effective backlight signal under each pixel of input image data is needed, so interpolation of the effective backlight table is performed in interpolation block 526.

Figure 5:
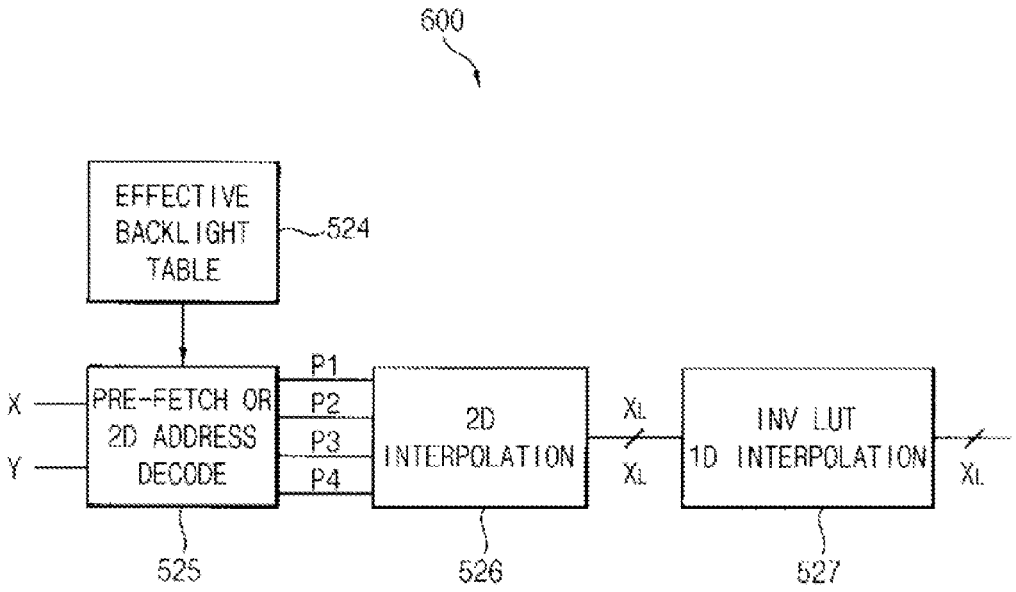
FIG. 5 is a diagram of blocks that perform the interpolation of the effective backlight table.

FIG. 5 is a block diagram 600 of 2D interpolation of the effective backlight table. The effective backlight signal values are generated by a 2D interpolation (526) between the 4 closest values in the effective backlight table (524). A 2D interpolation requires four values from the table at each step (16 if cubic interpolation is used). These four values, represented in FIG. 5 as P1, P2, P3 and P4, only change when the next pixel to be processed is on the other side of a boundary between effective backlight signal values. Before the first pixel arrives on each line there will be time to fetch these four values. As the pixels across a line arrive, there will be time to fetch the next two values in advance of crossing a boundary. FIG. 5 block 525 represents the fetching function which retrieves P1, P2, P3 and P4 from the Effective Backlight Table based on address x, y. Address x, y is determined by the current pixel's coordinates or position on the display. After 2D interpolation (526), the pixel-based $X_L$ is provided to the $X/X_L$ block. Block 527 represents an alternate implementation of $X/X_L$ that differs from FIG. 4 block 540. Instead of the $X/X_L$ divider, a sub-sampled lookup table (LUT) and simple 1D interpolation performs the same calculation.

A simulation code (in pseudo-code Lua) for the interpolation block 526 is shown in Table 2. The simulation code uses a digital differential analyzer ("DDA"). The DDA decides when to advance to the next boundary crossing based on a remainder term and the size parameter.

TABLE 1

```
            --generates the low rez effective backlight table
function buildfuz4(ledbuf,fuzbuf)
    xtab,ytab=PSF3D.xsiz,PSF3D.ysiz        --size of the sample table
      spr.create(fuzbuf,xtab,ytab,3,2)
      spr.create(fuzbuf.."M",xtab,ytab,3,2)
      spr.loop(xtab,ytab,1,1,function(x,y)                --loop for all the sample points
        local rs,gs,bs=0,0,0                --sum of point spread function
        local rm,gm,bm=0,0,0                --point spread if LED's on maximum
        local num=0                                --number of LED's in the sum
        for yl=0,ybak−1 do                  --loop for all the led blocks down
            for xl=0,xbak−1 do                      --and across
                    --fetch the backlight values
                local r,g,b=spr.fetch(ledbuf,xl,yl)
                    --fetch the PSF value
                local p=PSF3D[(xl+yl*8)+64*(33*y+x)]
                  rs,gs,bs = rs+p*r/MAXCOL,gs+p*g/MAXCOL,bs+p*b/MAXCOL
                                        --what the backlight would be here if on full
                  rm,gm,bm = rm+p,gm+p,bm+p
            end --for all led blocks across
        end -- for all rows of pixels
        mxx=math.max(mxx,rs,gs,bs)
        rs=rs*PSFNRM/(MAXCOL+1)    --PSFNRM will be a fixed constant in hardware version
        gs=gs*PSFNRM/(MAXCOL+1)
        bs=bs*PSFNRM/(MAXCOL+1)
        spr.store(fuzbuf,x,y,rs,gs,bs)
        rm=rm*PSFNRM/(MAXCOL+1)
        gm=gm*PSFNRM/(MAXCOL+1)
        bm=bm*PSFNRM/(MAXCOL+1)
        maxpsf=math.max(maxpsf,rm,gm,bm)     --keep statistics about the maximums
        spr.store(fuzbuf.."M",x,y,rm,gm,bm)
      end)   --all sample points
end    --buildfuz4
```

TABLE 2

```
--Here is a picture of how the interpolation is done (for red only)
--r1      r2
--r5  r7  r6
--r3      r4
-- the 4 corner values, r1 r2 r3 and r4 are read in (or are already available)
-- r5 is calculated between r1 and r3 (or moved in from the last r6 value)
-- r6 is calculated between r2 and r4 (only done as you cross from one interpolation zone
to another)
-- r7 is calculated between r5 and r6 (done once per pixel) r7 is the red value under
pixel x,y
function interpbuf(ebt,full)    --interpolate the reduced EBT up to a full sized one
    spr.create(full,xsiz,ysiz,3,2)
    local size=2^12             --convert the interp divides into multiply/shift
                                --these can be calculated before
    local xstep=math.floor(((PSF3D.xsiz-1)*size)/xsiz)
    local ystep=math.floor(((PSF3D.ysiz-1)*size)/ysiz)
    local yrem=0
    local yp=0
            --the hardware pre-loads the first set of values for interpolation
    local r1,g1,b1 = spr.fetch(ebt,0,0)
    local r2,g2,b2 = spr.fetch(ebt,1,0)
    local r3,g3,b3 = spr.fetch(ebt,0,1)
    local r4,g4,b4 = spr.fetch(ebt,1,1)
            --the first vertical interpolations is just the leftmost values
    local r5,g5,b5=r1,g1,b1
    local r6,g6,b6=r2,g2,b2
    for y=0,ysiz-1 do
        local xrem,xp=0,0
        for x=0,xsiz-1 do
                --interpolate horizontally
            local r7 = (r5*(size-xrem) + r6*xrem)/size
            local g7 = (g5*(size-xrem) + g6*xrem)/size
            local b7 = (b5*(size-xrem) + b6*xrem)/size
            spr.store(full,x,y,r7,g7,b7)
            xrem=xrem+xstep
            if xrem>=size then
                xp=xp+1
                xrem=xrem-size
                r5,g5,b5=r6,g6,b6               --move the horizontal values over one
                        --fetch the next two values horizontally
                        --(this can be done in paralell in advance)
                r2,g2,b2 = spr.fetch(ebt,xp+1,yp )
                r4,g4,b4 = spr.fetch(ebt,xp+1,yp+1)
                        --next right interpolation vertically
                        --(also can be cone in advance)
                r6 = (r2*(size-yrem) + r4*yrem)/size
                g6 = (g2*(size-yrem) + g4*yrem)/size
                b6 = (b2*(size-yrem) + b4*yrem)/size
            end
        end --x loop acrosss
        yrem=yrem+ystep
        if yrem>=size then
            yp=yp+1
            yrem = yrem-size
        end
        r1,g1,b1 = spr.fetch(ebt,0,yp )  --during horizontal retrace,
        r2,g2,b2 = spr.fetch(ebt,1,yp )--fetch a new set along the left image edge
        r3,g3,b3 = spr.fetch(ebt,0,yp+1)
        r4,g4,b4 = spr.fetch(ebt,1,yp+1)
        r5 = (r1*(size-yrem) + r3*yrem)/size      --do vertical interpolation on left
        r6 = (r2*(size-yrem) + r4*yrem)/size      --and right side of interpolation quad
        g5 = (g1*(size-yrem) + g3*yrem)/size          --same in green
        g6 = (g2*(size-yrem) + g4*yrem)/size
        b5 = (b1*(size-yrem) + b3*yrem)/size          --same in blue
        b6 = (b2*(size-yrem) + b4*yrem)/size
    end --y loop down
end
```

After the 2D interpolation, the resulting effective backlight signal is the values $X_L$ under the current pixel. This calculation is performed three times, to make and $R_L$, $G_L$ and $B_L$ values, referred to as $X_L$ for the general case. The $X_L$ value can be inverted by looking it up in an inverse table so that a multiplier could be used (storing the resulting INVy value as a fixed point binary fraction), as shown in FIG. 5 block 527. These operations may alternatively be performed with a hardware divider, as shown in FIG. 4 block 540.

Block 108 of FIG. 4 is the survey module. The survey module 108 surveys input image data values and the results of the GMA from block 142. The input values are delayed so that they are available at the same time as the GMA results. Then a single survey is performed.

As the pixels of image data arrive, the survey finds the maximum Red, Green, Blue and White pixel values that lie inside the survey area for each LED zone. With respect to the modified image data from the GMA, as the GMA results arrive, they are surveyed one pixel at a time and statistics are kept for each LED zone survey area. The results of these two surveys are a maximum input image data value and a maximum GMA value for each survey area. The input values are 12-bits wide, the GMA values are allowed to go out of gamut and can be 13 (perhaps 14) bits wide. In this implementation, the GMA values are shifted right once and clamped to 12-bit values to allow similar hardware to survey both the input and GMA values.

The survey area was defined by a survey radius and is actually two values in the descriptor, ledXsry and ledYsrv. These are used as a simple bounding box around the center position of each LED zone to determine if the x,y position of the current pixel is inside the particular survey area for that LED zone.

Figure 6:
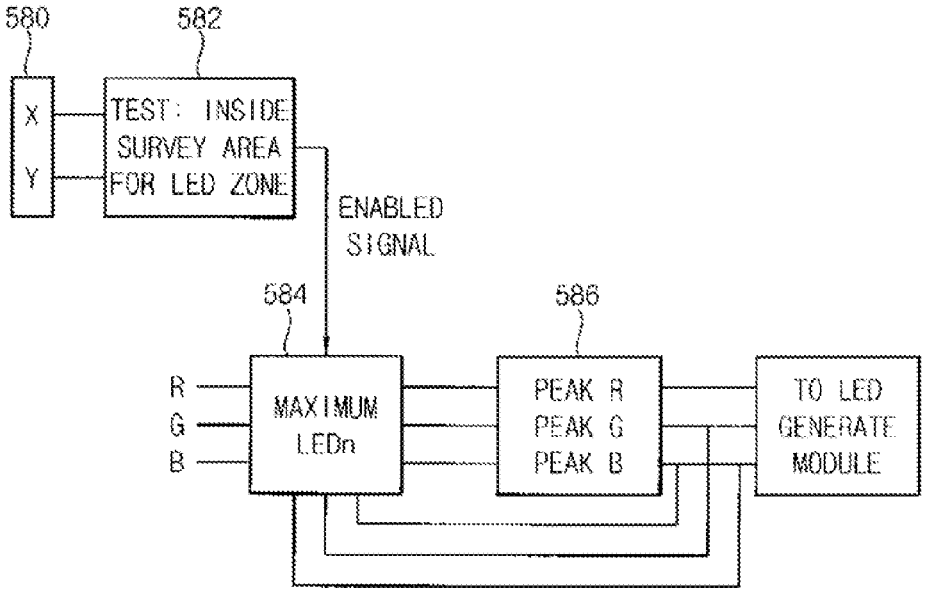
FIG. 6 is a diagram of blocks that perform the survey function.

There were 8×6, or 48, LED zones in the current design so 48 sets of statistics needed to be kept simultaneously. These were calculated in 48 similar modules as diagrammed below in FIG. 6. Each of the 48 modules work in parallel with the current pixel values. In FIG. 6, the x,y position of the current pixel is input to the test module (block 582). If true, its R, G, B values are compared in block 584 with previous peak values. Whichever is greater is saved in block 586. This is performed for each pixel.

The peak value modules are reset at the start of each frame, which sets the peak values to zero. As each pixel arrives the x,y position of the pixel is compared with the position of the survey area for the LED zone (FIG. 6, block 582). If the pixel is inside the survey area for the LED zone, then the maximum of the previous peak values compared against the pixel RGB values (block 584) are latched. By the end of the survey, the final peak values remain as Peak R, Peak G and Peak B (block 586). This is done separately for GMA in input image values.

Table 3 is the function in pseudo-code Lua for surveying the input image data and the results from the GMA (GMA output):

TABLE 3

```
function survey(srvbuf1,srvbuf2)          --survey the input and the gma
                                          output
          --first, zero the peak value tables
    for i=0,xbak*ybak do peakr[i],peakg[i],peakb[i]=0,0,0 end
    for i=0,xbak*ybak do inpeakr[i],inpeakg[i],inpeakb[i]=0,0,0 end
        --loop for all the pixels (simulate the arrival of pixels in the
        stream)
    spr.loop(xsiz,ysiz,1,1,function(x,y)
        local r,g,b=spr.fetch("ingam",x,y)
        local rw,gw,bw,ww = spr.fetch("gma",x,y)
        for yl=0,ybak−1 do        --loop for all the led blocks across
          for xl=0,xbak−1 do     --and down
            local xp=xl*ledXsep+ledXoff --center position for this led
            local yp=yl*ledYsep+ledYoff
            if AND(yl,1)==0 then
                xp = xp + ledEoff
            else
                xp = xp + ledOoff
            end
            local ind=xl+yl*xbak     --index to peak tables
                    --if this led is inside the radius
            if math.abs(x−xp)<=ledXsrv and math.abs(y−yp)<=
            ledYsrv then
                peakr[ind]=math.max(peakr[ind],rw)
                peakg[ind]=math.max(peakg[ind],gw)
                peakb[ind]=math.max(peakb[ind],bw)
                inpeakr[ind]=math.max(inpeakr[ind],r)
                inpeakg[ind]=math.max(inpeakg[ind],g)
                inpeakb[ind]=math.max(inpeakb[ind],b)
              end
            end
          end --for all leds
      end) --for all input pixels
  end
```

After the survey is done, the 48*3 peak input image values could be used directly to drive the LED zones of the backlight. However, additional processing is performed in the decay module 510.

The GMA values are 12-bits, and values larger than 2048 are out of gamut (values below 2048 are in gamut). So the backlight drive values for the LED zones are multiplied by the GMA values and divided by 2048, which increases or decreases the backlight drive values correctly.

Using a multiplier only would result in backlight values that stick at 0 and cannot increase. Taking the maximum of the (GMA value)×(previous frame backlight drive value) and the results of the survey on the input image data prevents this, and also allows the backlight to respond quicker to a sudden change in the image.

They decay module 510 uses a simple binary exponential decay, to decay the new backlight drive values with the backlight drive values of the previous frame (multiplied by the GMA values). The binary exponential decay is used to guarantee that the backlight will decay to the new setting in 12 frames or less.

Manufacturing

Because the local dimming architecture for a display system described herein provides a method for accommodating irregular backlights, it also provides a method for simplifying and saving costs in the manufacture of backlights for display systems.

When manufactured, light emitting diodes do not generally all produce exactly the same amount of light for the same drive level. Thus, to account for this irregularity, in the manufacture of backlight modules for display systems that use LEDs as light emitters, a process of "binning" is required. Binning is a process of selecting LEDs to be included in a backlight. In this process, the amount of light output from each LED is measured and then LEDs having similar output levels are grouped (binned). The backlight is then manufactured to include LEDs having the same amount of output at the same drive level, that is, LEDs from the same bin, so that a uniform backlight is achieved.

Using the methods provided herein, "binning" would be unnecessary. The backlight is formed from functional LEDs with no need to "bin" them. The PSF for each light emitting zone of the backlight is then measured, as described above. The light emitting zone may be each LED or a group of LEDs. The measured PSF data, most often in the form of a PSF LUT, is then loaded into the display system, and any irregularity in the backlight LEDs is accounted for by manipulation of the image data, as described above.

Furthermore, such method could be used for globally dimmed dynamic backlights (or even a backlight that doesn't do dynamic dimming). In such cases the architecture would be substantially the same as described for local dimming except instead of representing an N×M array of zones, only a 1×1 array of zones (i.e., a single PSF that would account for the irregularities over the single (global) backlight). The irregularities which may arise from un-binned LEDs and/or non-optimally spaced LEDs would be characterized and stored in the PSF data structure and compensated by the LCD valves by leveraging the accurate effective backlight modeling embodied in this architecture.

Exemplary Implementation of Functional Operations

The functional operations in the modules and/or blocks described in this specification can be implemented in digital electronic circuitry, or in computer software, firmware, or hardware, including the structures disclosed in this specification and their structural equivalents, or in combinations of one or more of them. Embodiments of the invention can be implemented as one or more computer program products, i.e., one or more modules of computer program instructions encoded on a computer-readable medium for execution by, or to control the operation of, data processing apparatus.

A computer program (also known as a program, software, software application, script, or code) can be written in any form of programming language, including compiled or interpreted languages and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

The invention claimed is:

1. A display system comprising:

a display panel configured to display image data;

a backlight configured to illuminate the display panel, the backlight including one or more light emitting zones, each light emitting zone being configured to emit light in response to a backlight drive value which controls an amount of light emitted from that light emitting zone;

a backlight selection module configured to select the backlight drive value for each light emitting zone from the image data of an nth frame of image data, where n is a natural number;

an effective backlight module which generates effective backlight signals of the nth frame of image data using light spread information for the backlight and the backlight drive values, wherein the light spread information includes information representing the combined contribution of light spread from each individual light emitting zone, wherein the light spread by each individual light zone is the amount of light provided by the individual light zone over the display panel; and a module configured to modulate the image data of an (n +1)th frame of image data based on the effective backlight signal of the nth frame of image data and providing the display panel with the modulated image data, wherein the effective backlight module is configured to generate a table of effective backlight signals of the nth frame of image data having a lower resolution than the image data and includes an interpolation block configured to interpolate the low resolution table of effective backlight signals to produce the effective backlight signal of the nth frame of image data for each pixel of image data, and provide the effective backlight signals of the nth frame of image data for each pixel of image data for corresponding pixels of image data in the (n +1)th frame of image data to the module as the module receives the pixels of image data of an (n +1)th frame of image data, wherein the effective backlight module comprises a dual-ported memory configured to interpolate the low resolution table of effective backlight signals by performing in parallel with modifying an image data for an (n +1)th frame.

2. The display system of claim 1, wherein the light spread information is point spread function data and contained in a point spread function (PSF) table.

3. The display system of claim 2, wherein the effective backlight module uses the PSF table to generate the table of effective backlight signals, the table of effective backlight signals having lower resolution than the image data.

4. The display system of claim 1, wherein the effective backlight module comprises:

a look up table including the light spread information; and a block for generating the table of effective backlight signals using the look up table, the table of effective backlight signals having a lower resolution than the image data.

5. The display system of claim 1, wherein the image data comprises a plurality of pixel data, and each pixel data is divided by an effective backlight signal corresponding to that pixel to generate the modified image data for each pixel.

6. The display system of claim 1, wherein each light emitting zone comprises one or more light emitting diodes.

7. The display system of claim 1, wherein each light emitting zone comprises colored light emitters.

8. The display system of claim 1, wherein the light spread information includes data modeled on each light emitting zone of the backlight.

9. The display system of claim 1, wherein the backlight selection module comprises:

a survey block for surveying the image data in a survey area of each light emitting zone and determining an initial backlight drive value for each light emitting zone, wherein the survey area of each light emitting zone includes a set of pixel data to be displayed on an area of the display panel; and a decay block using a smoothing function to modify the initial backlight drive value to generate the backlight drive value.

10. The display system of claim 9, wherein the decay block includes backlight drive values from a previous frame to modify the initial backlight drive values.

11. The display system of claim 9, further comprising a gamma mapping module for converting the modulated image data from a three-color value data to a multi-primary color value data.

12. The display system of claim 11, wherein the survey block receives the multi-primary color value data and surveys the multi-primary color value data in each survey area to determine a gamut mapping (GMA) value, and wherein the decay block uses the GMA values and backlight drive values from a previous frame to generate the backlight drive value from the initial backlight drive values.

13. A method for displaying an image, the method implemented in a display system comprising a backlight which illuminates a display panel, the backlight including one or more light emitting zones, each light emitting zone being configured to emit light in response to a backlight drive value, the method comprising:

receiving image data for an nth frame, where n is a natural number, into the display system; determining a backlight drive value for each light emitting zone from the image data for the nth frame; loading a light spread information table into the display system, the light spread information table including point spread function information for each light emitting zone, wherein the point spread function information for each light emitting zone is the amount of light provided by the light emitting zone over the display panel; generating a low resolution table of effective backlight signals from the backlight drive values determined using image data for the nth frame and the light spread information table; interpolating the low resolution table of effective backlight signals for the nth frame to produce an effective backlight signal for each pixel of image data in the nth frame; modifying an image data for an (n +1)th frame received into the display system by the effective backlight signal of the nth frame to generate a modified image signal; and providing a modified image signal to the display panel, wherein interpolating the low resolution table of effective backlight signals is performed in parallel with modifying an image data for an (n +1)th frame.

14. The method of claim 13, wherein generating the modified backlight signals includes generating a table of initial effective backlight signals having a lower resolution than the image data, and interpolating the table of initial effective backlight signals to a resolution of the image data before generating the modified image signal.

15. The method of claim 13, wherein the image data comprises a plurality of pixel data, and each pixel data is divided by an effective backlight signal corresponding to that pixel to generate the modified image signal.

16. The method of claim 13, wherein determining a backlight drive value for each light emitting zone from the image data comprises:

surveying the image data in a survey area of each light emitting zone to determine an initial backlight drive value for each light emitting zone, wherein the survey area of each light emitting zone includes a set of pixel data to be displayed on an area of the display panel; and decaying the initial backlight drive values with a smoothing function to generate the backlight drive values.

17. The method of claim 16, wherein decaying the initial backlight drive values includes decaying the initial backlight drive values with backlight drive values from a previous frame to modify the initial backlight drive values.

18. The method of claim 17, further comprising:

converting the image data from a three-color value data to a multi-primary color value data.

19. The method of claim 18, further comprising surveying the multi-primary color value data in each survey area to determine a gamut mapping (GMA) value, and decaying the initial backlight drive values with the GMA values and backlight drive values from a previous frame to generate the backlight drive values.

* * * * *